United States Patent [19]

Moser

[11] 4,042,804

[45] Aug. 16, 1977

[54] ROLL FUSER APPARATUS

[75] Inventor: Rabin Moser, Fairport, N.Y.

[73] Assignee: Xerox Corporation, Stamford, Conn.

[21] Appl. No.: 616,452

[22] Filed: Sept. 24, 1975

[51] Int. Cl.[2] ..... H05B 1/00; G03G 15/00

[52] U.S. Cl. ..... 219/216; 29/122; 432/60

[58] Field of Search ..... 219/216, 469–471; 100/93 RP; 432/60, 228; 29/132, 122

[56] References Cited

U.S. PATENT DOCUMENTS

| | | | |
|---|---|---|---|
| 3,861,863 | 1/1975 | Kudsi | 219/216 X |
| 3,912,901 | 10/1975 | Strella | 219/216 |

OTHER PUBLICATIONS

R. D. Fathergill et al., *Roll Fuser,* IBM Technical Disclosure Bulletin, vol. 16, No. 3, p. 896, Aug. 1973.

*Primary Examiner*—C. L. Albritton

[57] ABSTRACT

An improved pressure and heat fusing apparatus for a copier or duplicator apparatus capable of either simplex or duplex operation including a first roll which is heated to a temperature sufficient to fuse toner images onto support material and a second elastomeric roll arranged axially parallel with the first roll to define a nip through which support material bearing toner images is passed. The second roll is constructed such that its ends move the support material faster at the ends of the support material than at the center thereof.

11 Claims, 4 Drawing Figures

ROLL FUSER APPARATUS

This invention relates generally to xerographic copying apparatus and, more particularly, to a contact fusing system for fixing electroscopic toner material to a support member or members.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to the point at which the constituents of the toner material coalesce and become tacky. This action causes the toner to be absorbed to some extent into the fibers of the support member which, in many instances, constitutes plain paper. Thereafter, as the toner material cools, solidification of the toner occurs causing it to be firmly bonded to the support member. In both the xerographic as well as electrographic recording arts, use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip.

When a sheet of substantially falt paper is fed between a pair of fuser roll members there are numerous forces acting on it. Some of these forces result in a permanent deformation of the paper which is commonly referred to as paper wrinkle. One mechanism that results in paper wrinkle involves driving the center of the sheet of paper faster than its edges. Depending upon the magnitude of this speed differential and the rigidity of the paper, a varying degree of wrinkle results. Differential driving speeds may result from excesive toner pile heights and/or mis-registration of the sheet as it enters the nip formed between the roll members.

It is therefore a general object of this invention to improve the quality of copy material produced by copier and duplicator apparatus.

It is another object of this invention to minimize copy sheet wrinkle from a copier or duplicator employing roll fusing members for fixing toner images to the copy sheet.

Yet another object of this invention is to provide a fuser apparatus including a heated roll fuser member wherein at least one of the fuser members is designed such that a copy sheet is moved through the nip formed between the rolls at a faster rate along its edges than at the center thereof.

BRIEF SUMMARY OF THE INVENTION

Briefly, the above-cited objects are accomplished by the provision of a contact fuser apparatus comprising, in one form thereof, a metal fuser roll structure cooperating with a resilient backup roll to form a nip through which substrates carrying toner images are passed with the toner images contacting the fuser roll structure.

In one embodiment of the invention the backup roll structure forming one of the members of a fuser roll pair comprises a core which has a non-uniform cross section throughout its axial extent and which is symmetrical about the longitudinal center thereof. Attached to the aforementioned core is an elastomeric outer layer which also has a non-uniform cross section, its shape being complementary to the shape of the core such that the roll structure has a uniform radius or diameter throughout its longitudinal extent. In other words, the structure comprising the non-uniform cross sectional core and the non-uniform cross sectional outer layer result in a structure whose cross section is uniform.

The aforementioned described roll is so constructed that the elastomeric material thickness is greater at the center thereof than it is adjacent its ends. Thus, the force applied between the rolls to form the customary nip between such roll members effects a greater elongation of the surface of the roll member where the elastomeric material is thinnest, therefore, adjacent its ends. In other words, the circumference of the roll adjacent the roll ends is greater than it is at the center. Since the angular velocity of the ends of the rolls are necessarily the same as its center, and because of the aforementioned elongation differential, more roll surface, adjacent the ends of the roll, must pass through the nip for a given period of time than at the center. Accordingly, the edges of the paper must pass through the nip adjacent the ends of the roll at a greater speed than at the center.

Other objects and advantages of the present invention will become apparent when read in conjunction with the accompanying drawings.

DETAILED DESCRIPTION OF THE PREFERRED EMBODIMENTS

Since the xerographic reproducing process is well known, a detailed description thereof is omitted. For those who would consider a description of the xerographic process necessary for a complete understanding of the present invention reference may be had to U. S. Pat. Nos. 3,718,116 and 3,745,972 which are incorporated herein by reference.

Figure 1:
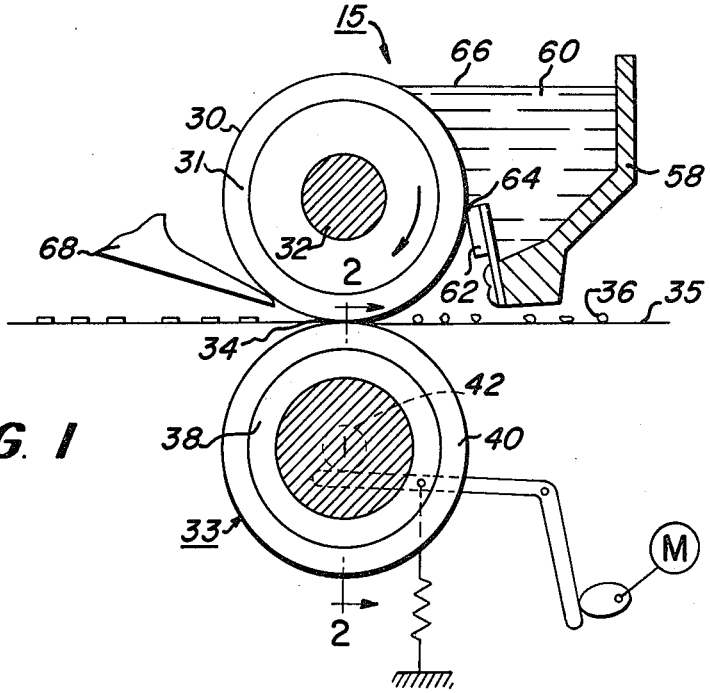
FIG. 1 is a side elevational view of a contact fuser representing the invention.

As illustrated FIG. 1, the present invention comprises a fuser assembly 15 including a heated roll structure 30 including a hollow cylinder or core 31 having a suitable heating element 32 disposed in the hollow portion thereof which is coextensive with the cylinder. The heating element 32 may comprise any suitable type heater for elevating the surface temperature of the cylinder to operational temperatures, therefore, 250°–400° F. For example, it may be a quartz lamp. The cylinder or core 31 is fabricated from any suitable material capable of effecting fusing of toner images on copy material. Typical materials are copper, anodized aluminum and alloys thereof, steel, stainless steel, nickel and alloys thereof, nickel plated copper and chrome plated copper. The resulting structure has an outside diameter on the order of 1.5 to 3.0 inches and has a length on the order of 10 to 15 inches. Power requirements for the foregoing are 500–2500 watts peak power with an average power of 300–2000 watts and 75-250 watts for standby.

The surface temperature of the fuser roll structure may be controlled by contacting the surface thereof with a thermistor probe (not shown) in a manner described in U. S. Pat. No. 3,327,096, issued in 1967 to Bernous and incorporated herein by reference.

The fuser assembly 15 further comprises a backup roll structure 33 which cooperates with the fuser roll structure 30 to form a nip 34 through which a copy paper or substrate 35 passes such that toner images 36 thereon contact the fuser roll structure. The backup roll structure comprises a rigid core 38 fabricated from a suitably hard material such as steel.

Figure 2:
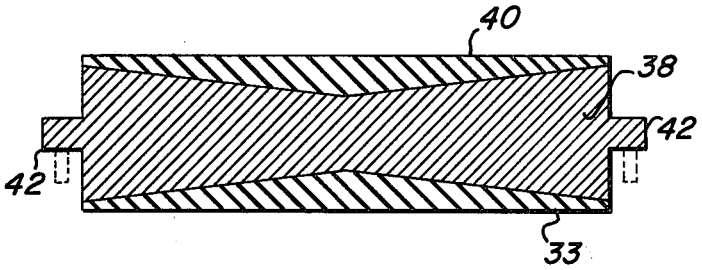
FIG. 2 is a cross-sectional view taken on the line II—II of FIG. 1.

As depicted in FIG. 2, the rigid core 38 has a non-uniform cross section as measured along the longitudinal axis thereof, such non-uniformity being for a purpose to be discussed hereinafter. A layer of elastomeric material 40 is bonded to the outer surface of the core 38 to form therewith a unitary structure representing the backup roll structure 33. Typical materials from which the elastomeric layer 40 may be fabricated are silicone rubber, fluorosilicone rubber and Viton. Viton is a trademark of E. I. duPont de Nemours and Company. The elastomeric layer as can be seen from FIG. 2 also has a non-uniform cross section taken along the longitudinal axis thereof which cross section is complementary to that of the core 38 to thereby form a backup roll structure having a uniform cross section along the same axis.

Means generally indicated by reference character 60 and comprising a lever arm, cam, bias spring and motor for rotating the cam for applying a loading force in a conventional manner to the fuser assembly 30 serves to create pressures on the order of 50 to 150 psi average. The durometer of the backup roll is chosen such that "dwell times" of 5 to 100 milliseconds can be obtained with the loading forces within the aforementioned range of pressures. "Dwell time" is proportional to the ratio of the nip length to the surface speed of the rolls. For a given angular velocity the surface speeds will vary depending upon the diameter of the rolls. For example with a 2 inch fuser rolls, speeds of 0 to 30 inches per second are obtainable for a three-inch fuser roll, speeds of 0 to 45 inches per second have been obtained. Accordingly, it can be seen that the aforementioned dwell times can be obtained by varying one or the other or both of the dwell time relationships. Durometers of 20–90 shore A have been found to provide satisfactory results.

As can be seen from FIG. 2 the thickness of the elastomeric material 40 at the center of the roll structure 33 is thicker than it is adjacent the ends of the roll structure. Accordingly, the forces which are applied to form the nip 34 effect a greater elongation of the surface of the roll 33 adjacent the edges thereof than at the center thereof. The foregoing results in more surface 33 adjacent the ends thereof moving through the nip for a given period of time than at the center which tends to move the edges of the copy paper moving through the nip 34 at a greater rate than experienced at the center thereof.

The backup roll structure 33 can be fabricated by molding the elastomeric layer 40 onto the core 38 by means of a non-cylindrical mold to thereby provide a roll structure which has a uniform cross section. The resulting roll structure preferably has a diameter on the order of two inches with an elastomeric layer thickness of 0.22 inches at the center thereof and a thickness on the order of 0.2 inches at the ends thereof, where the length of the roll is 15 inches. The roll structure 33 is provided with a pair of shaft ends 42 for rotatably supporting the roll structure 33 in its operating position.

Figure 3:
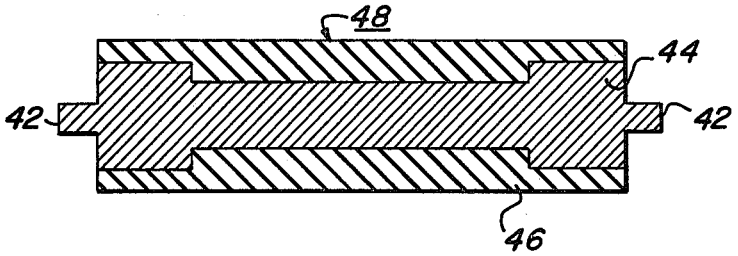
FIG. 3 is a cross-sectional view of a modified form of the fuser member illustrated in FIG. 2.

As disclosed in FIG. 3, a modified form of the backup roll disclosed in FIG. 2 comprises a core 44 and an elastomeric layer 46 which form a unitary backup roll structure 48 identical in overall size and external dimensions to that of the roll structure 33 and containing the same or similar materials for the core 44 and the elastomeric layer 46. The core 44 represents a configuration different from the core 38 of FIG. 2 but provides for thicknesses of elastomeric material comparable to that provided by the roll structure 33 thereby resulting in the same function as the roll structure 33.

Figure 4:
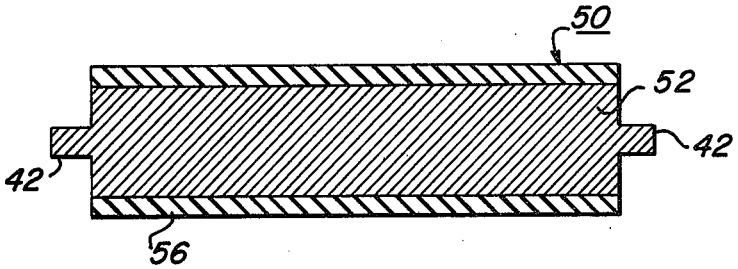
FIG. 4 is a cross-sectional view of another modified form of the fuser member illustrated in FIG. 2.

Another modified form of the roll structure disclosed in FIGS. 2 and 3 is disclosed in FIG. 4. The modification shown in FIG. 4 comprises a roll structure 50 having a rigid core 52 which unlike the embodiments of FIGS. 2 and 3 has a uniform cross section along its longitudinal axis. The roll structure 50 also comprises an outer layer 56 which has a thickness on the order of 0.2 inches and has a uniform cross section along its longitudinal axis. The elastomeric layer 56 differs from the layers 40 and 46 in that the durometer thereof at the center is substantially lower than the durometer adjacent the ends of the roll structure 50. For example, the durometer of the layer 56 at the center may be on the order of 65 shore A while the durometer of the layer adjacent the ends of the roll structure 50 may be on the order of 80 shore A hardness.

The aforementioned materials from which the fuser roll structure 30 may be fabricated are relatively high surface energy materials, consequently, hot toner material contacting such surfaces would readily wet the surface of the fuser roll. Accordingly, there is provided a sump 58 for containing release material 60 capable of interacting with the fuser roll. Release material is preferably a low molecular weight material which is solid at room temperature and which has a relatively low viscosity at the operating temperatures of the fuser roll structure. An example of such material is polyethylene homopolymer manufactured by Allied Chemical Company and having the designation AC-8 homopolymer.

A metering blade 62 preferably of silicone rubber is mounted to the sump 58 by conventional means such that an edge 64 thereof contacts the fuser roll structure serving to meter the release agent 60 in its liquid state onto the fuser roll. In the preferred embodiment, a blade 0.060 inch thick and having a width of 1.0 inch and length of 15 inches has been employed. By means of such a construction a 0.1–0.5 micron thickness of release agent is applied to the surface of the fuser roll.

A pair of end seals 66, preferably of sponge rubber are provided to contain the release agent material 60 in the sump 58. One or more stripper fingers 68 are provided for insuring removal of the substrate from the fuser roll.

While the invention has been shown and described in conjunction with the preferred embodiments thereof, it will be understood that various modifications thereto may be made by those skilled in the art without departing from the spirit of the invention, for example, the elastomeric layers forming the outer surfaces of the backup roll structures could be covered with a relatively thin layer of Teflon or the like material or the fuser roll structure could be fabricated similarly to that of the backup structure where an external source of heat is provided to elevate the surface temperature of the fuser roll structure, and such modifications are intended to be covered by the claims appended thereto.

What is claimed is:

1. Fuser apparatus for fixing toner images to substrate material, said apparatus comprising:

a fuser roll member;

a backup roll member;

means for effecting engagement of said roll members to apply a force between said roll members to thereby form a nip therebetween through which said substrate material passes with said toner images contacting said fuser roll said means also effecting disengagement to remove said force;

one of said roll members comprising a rigid thermally stable core and an outer layer which has a substantially uniform circumference along its longitudinal axis when said force is not applied and when said force is applied has a non-uniform circumference along its longitudinal axis whereby portions thereof adjacent its ends have a longer surface length than the center portion thereof whereby the edges of said substrate material are moved through said nip at a faster speed than the center thereof.

2. Apparatus according to claim 1 wherein the thickness of said outer layer is less adjacent the ends of said one of said roll members than it is at the center thereof.

3. Apparatus according to claim 1 wherein said layer has a substantially uniform thickness and the durometer thereof is greater adjacent the ends of said one of said roll members than it is at the center thereof.

4. Apparatus according to claim 2 wherein the thickness of said layer adjacent the ends of one of said roll members is about 0.2 inches and the thickness thereof at the center is about 0.22 inch.

5. Apparatus according to claim 4 wherein said layer is fabricated from silicone rubber.

6. Apparatus according to claim 4 wherein the inner surface of said layer is gradually tapered between its ends and its center and said core has a complementary outer surface.

7. Apparatus according to claim 4 wherein said laer has a step configuration.

8. Apparatus according to claim 3 wherein said layer is fabricated from silicone rubber.

9. Appartus according to claim 5 wherein said one of said roll members comprises said backup roll member.

10. Apparatus according to claim 8 wherein said one of said roll members comprises a backup roll member.

11. Apparatus according to claim 1 including means for elevating the temperature of said fuser roll member.

* * * * *